US010672320B2

(12) United States Patent
Lin et al.

(10) Patent No.: US 10,672,320 B2
(45) Date of Patent: Jun. 2, 2020

(54) APPLYING GAIN AND OFFSET CORRECTION FACTORS FOR PIXEL UNIFORMITY COMPENSATION IN DISPLAY PANELS

(71) Applicant: Apple Inc., Cupertino, CA (US)

(72) Inventors: Hung Sheng Lin, San Jose, CA (US); Soojin Park, Santa Clara, CA (US); Bhadrinarayana L. Visweswaran, Santa Clara, CA (US); Chieh-Wei Chen, Campbell, CA (US); Anshi Liang, San Jose, CA (US); Marc Albrecht, San Francisco, CA (US); Pierre-Yves Emelie, Mountain View, CA (US); Sean C. Chang, Mountain View, CA (US); Hyunwoo Nho, Stanford, CA (US); Mohammad Hajirostam, San Jose, CA (US); Myung-Je Cho, San Jose, CA (US); Shengkui Gao, San Jose, CA (US); Wei H. Yao, Palo Alto, CA (US); Yafei Bi, Los Altos Hills, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/132,116

(22) Filed: Sep. 14, 2018

(65) Prior Publication Data

US 2019/0237001 A1 Aug. 1, 2019

Related U.S. Application Data

(60) Provisional application No. 62/623,946, filed on Jan. 30, 2018.

(51) Int. Cl.
*G09G 3/20* (2006.01)
*G09G 3/3208* (2016.01)

(52) U.S. Cl.
CPC ..... *G09G 3/2044* (2013.01); *G09G 3/3208* (2013.01); *G09G 2320/0233* (2013.01);
(Continued)

(58) Field of Classification Search
CPC ... G09G 2320/0233; G09G 2320/0242; G09G 2360/147; G09G 2360/16; G09G 3/2044; G09G 3/3208
See application file for complete search history.

(56) References Cited

U.S. PATENT DOCUMENTS 8,610,781 B2 12/2013 Wei et al.
9,135,851 B2 9/2015 Rykowski
(Continued)

*Primary Examiner* — Afroza Chowdhury
(74) *Attorney, Agent, or Firm* — Fletcher Yoder P.C.

(57) ABSTRACT

A display device may include a processor that may receive image data, such that the image data may include gray level data and display brightness value (DBV) data for a first pixel of a display. The processor may then determine a gain compensation factor associated with the first pixel based on a correction spatial map, a brightness adaptation lookup table (LUT), the gray level data, and the DBV data. The processor may then determine an offset compensation factor associated with the first pixel based on the correction spatial map, the brightness adaptation lookup table (LUT), the gray level data, and the DBV data. The processor may generate compensated gray level data by applying the gain compensation factor and the offset compensation factor to the gray level data and transmit the compensated gray level data to pixel driving circuitry associated with the first pixel.

18 Claims, 9 Drawing Sheets

(52) U.S. Cl.
CPC ..... *G09G 2320/0242* (2013.01); *G09G 2360/147* (2013.01); *G09G 2360/16* (2013.01)

(56) References Cited

U.S. PATENT DOCUMENTS

| | | | | |
|---|---|---|---|---|
| 2008/0042943 | A1 | 2/2008 | Cok | |
| 2013/0321671 | A1* | 12/2013 | Cote | H04N 5/365 348/241 |
| 2015/0002378 | A1 | 1/2015 | Nathan et al. | |
| 2017/0032742 | A1 | 2/2017 | Piper et al. | |
| 2018/0158173 | A1* | 6/2018 | Gao | G06T 5/009 |

* cited by examiner

APPLYING GAIN AND OFFSET CORRECTION FACTORS FOR PIXEL UNIFORMITY COMPENSATION IN DISPLAY PANELS

CROSS REFERENCE TO RELATED APPLICATIONS

This application is a Non-Provisional application claiming priority to U.S. Provisional Patent Application No. 62/623,946, entitled "Applying Gain and Offset Correction Factors for Pixel Uniformity Compensation in Display Panels", filed Jan. 30, 2018, which is herein incorporated by reference.

BACKGROUND

The present disclosure relates to systems and methods for compensating for non-uniformity properties in luminance or color of a pixel with respect to other pixels in the electronic display device.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As electronic displays are employed in a variety of electronic devices, such as mobile phones, televisions, tablet computing devices, and the like, manufacturers of the electronic displays continuously seek ways to improve the consistency of colors depicted on the electronic display devices. For example, given variations in manufacturing, various noise sources present within a display device, or various ambient conditions in which each display device operates, different pixels within a display device might emit a different color value or gray level even when provided with the same electrical input. It is desirable, however, for the pixels to uniformly depict the same color or gray level when the pixels programmed to do so to avoid visual display artifacts, color mixing between sub-pixels, frame mura, and the like.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain electronic display devices, light-emitting diodes such as organic light-emitting diodes (OLEDs), micro-LEDs (μLEDs), or active matrix organic light-emitting diodes (AMOLEDs) may be employed as pixels to depict a range of gray levels for display. However, due to various properties associated with the manufacturing of the display, the driving scheme of these pixels within the display device, and other characteristics related to the display panel, a particular gray level output by one pixel in a display device may be different from a gray level output by another pixel in the same display device upon receiving the same electrical input. As such, the digital values used to generate these gray levels for various pixels may be compensated to account for these differences based on certain characteristics of the display panel. For instance, a digital compensation value for a gray level to be output by a pixel may be determined based on optical wave or electrical wave testing performed on the display during the manufacturing phase of the display. In addition, the digital compensation value for the gray level may be determined based on real time color sensing circuitry, predictive modeling algorithms based on sensor data (e.g., thermal, ambient light) acquired by circuitry disposed in the display, and the like. Based on the results of the testing, sensing, or modeling, a correction spatial map that provides gain and offset compensation values for the pixels of the display may be determined. In addition, display brightness value (DBV) adaptation lookup table (LUT) and a gray conversion LUT may be generated for various gray levels at one or more luminance settings for each pixel of the display based on the results of the testing, sensing, or modeling. In any case, display driving circuitry may use the correction spatial map, the DBV adaptation LUT, and the gray conversion LUT to adjust the voltages and/or currents provided to each pixel of the display to achieve improved pixel uniformity properties across the display.

With the foregoing in mind, in certain embodiments, the correction spatial map may define a gain correction factor (e.g., multiplier) and an offset correction factor (e.g., voltage offset) for gray levels used in different portions (e.g., 3×3 pixel grid, 4×4 pixel grid) of the display to correct for non-uniform properties (e.g., process/manufacturing artifacts, mask misalignment) of the display. The DBV or brightness adaptation LUT may provide a scaling factor ($\beta$) that may be applied to each respective gain correction factor ($\alpha$) and each respective offset correction factor ($\sigma$) based on the gray level and brightness level specified for each pixel. In addition, the gray conversion LUT may include replacement gray level values for gray levels provided in image data to be depicted by pixels in the display based on the input gray level provided to the display driver circuitry. In one embodiment, the gray conversion LUT may include global replacement values for each gray level value that may be used an input value.

By way of operation, a compensation system of the display driver circuitry may receive a gray level value and a brightness value for each pixel of the display. Based on the location of each respective pixel, the compensation system may determine a gain correction factor ($\alpha$) and offset correction factor ($\sigma$) according to the correction spatial map. The compensation system may then apply a respective brightness adaptation factor ($\beta_1$, $\beta_2$) to the gain correction factor ($\alpha$) and the offset correction factor ($\sigma$), respectively, based on the received gray level and the received brightness value for the respective pixel.

After determining the resulting brightness-adapted gain factor (A) and the brightness-adapted offset factor ($\delta$), the compensation system may apply these factors to the input gray level value to generate a compensated gray level value to be provided to the respective pixel driving circuit that causes the respective pixel to illuminate to the desired gray level. By employing the gain and offset correction factors based on the correction spatial map and the brightness adaptation factors, the image data received by the pixels of the display may be compensated for various non-uniformity properties in depicting gray levels across the display.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
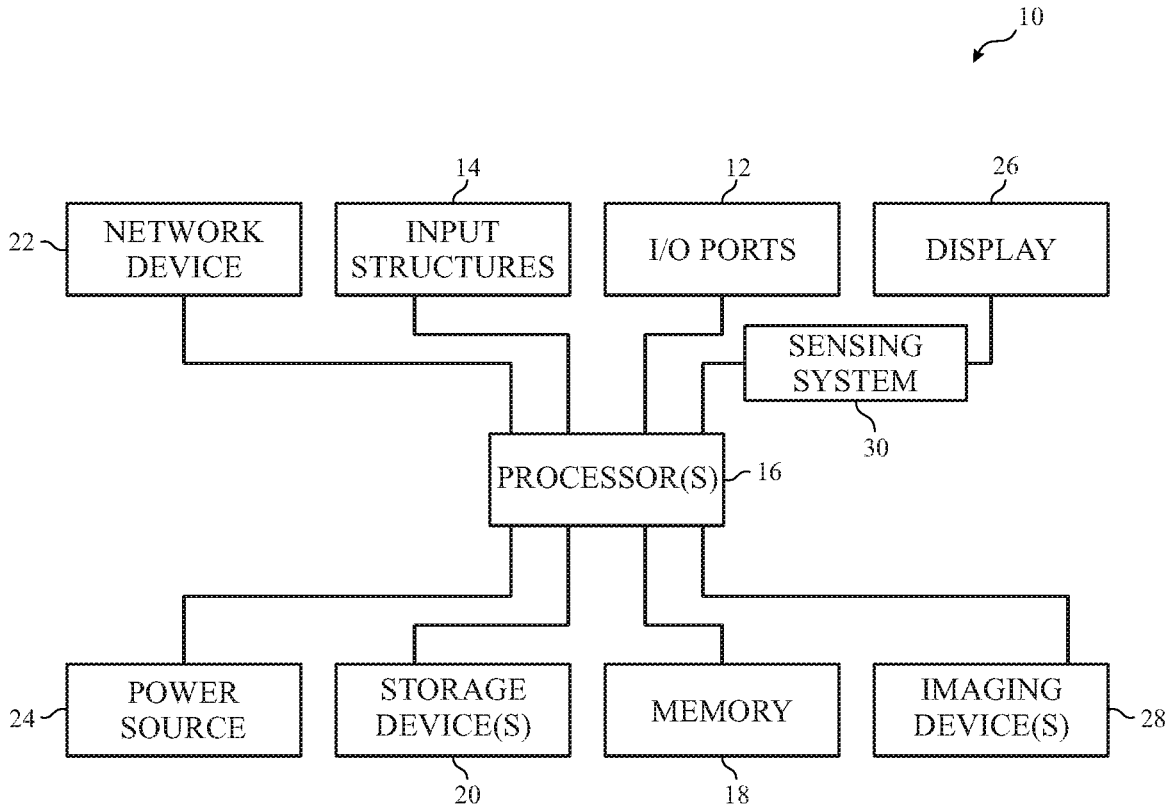
FIG. 1 is a simplified block diagram of components of an electronic device that may depict image data on a display, in accordance with embodiments described herein.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Organic light-emitting diode (e.g., OLED, AMOLED) display panels provide opportunities to make thin, flexible, high-contrast, and color-rich electronic displays. Generally, OLED display devices are current driven devices and use thin film transistors (TFTs) as current sources to provide certain amount of current to generate a certain level of luminance to a respective pixel electrode. OLED luminance to current ratio is generally represented as OLED efficiency with units: cd/A (Luminance/Current Density or $(cd/m^2)/(A/m^2)$). Each respective TFT, which provides current to a respective pixel, may be controlled by gate to source voltage ($V_{gs}$), which is stored on a capacitor ($C_{st}$) electrically coupled to the LED of the pixel.

Generally, the application of the gate-to-source voltage $V_{gs}$ on the capacitor $C_{st}$ is performed by programming voltage on a corresponding data line to be provided to a respective pixel. However, when providing the voltage on a data line, several sources of noise or variation in the OLED-TFT system can result in either localized (e.g., in-panel) or global (e.g., panel to panel) non-uniformity in luminance or color. Variations in the TFT system may be addressed in a number of ways. For instance, in one embodiment, pixel performance (e.g., output luminance/brightness) may be tested at certain times (e.g., during manufacturing of the display) to determine how each pixel of a display responds to different electrical inputs (e.g., emission current provided to pixel). By way of example, the pixels of a display may be provided electrical inputs to cause the pixels to depict various gray levels. The luminance value output by each pixel, when each pixel is provided with the same electrical input, may be captured via optical testing and used to determine the luminance value differences across the pixels of the panel. These differences may then be used to generate a multi-dimensional look up table (LUT) that includes gain and offset values for the pixels of the display. The gain and offset values may be applied (e.g., added) to the pixel data of input image data, such that each pixel of the display each responds to the same electrical input (e.g., current or voltage) similarly.

In addition to the gain and offset values, a lookup table may also be generated to provide scaling factors for each gain and offset value for each pixel of the display to compensate for various brightness properties (e.g., display brightness value) of various pixels in the display based on the desired gray level value and brightness level for each pixel. The scaling factor may be applied (e.g., multiplied) to the gain and offset values, such that the resulting scaled gain and offset values may compensate for various sources related to the non-uniform performances of pixels across the display panel. After determining the scaled gain and offset values for each pixel of the input image data, the scaled gain and digital offset values for each pixel may be incorporated into the original input gray level data for each pixel, thereby generating compensated gray level data. The compensated gray level data may then be provided to a pixel driving circuitry or to the respective pixels of the display to depict the image of the image data. By compensating for the non-uniform luminance properties of the pixels across the panel, the pixels used to display the resulting image may provide more uniform color and luminance properties, thereby improving the quality of the images depicted on the display. Additional details with regard to compensating pixel data for uniformity using gain and offset values will be discussed below with reference to FIGS. 1-11.

By way of introduction, FIG. 1 is a block diagram illustrating an example of an electronic device 10 that may include the sensing system mentioned above. The electronic device 10 may be any suitable electronic device, such as a laptop or desktop computer, a mobile phone, a digital media player, television, or the like. By way of example, the electronic device 10 may be a portable electronic device, such as a model of an iPod® or iPhone®, available from Apple Inc. of Cupertino, Calif. The electronic device 10 may be a desktop or notebook computer, such as a model of a MacBook®, MacBook® Pro, MacBook Air®, iMac®, Mac® Mini, or Mac Pro®, available from Apple Inc. In other embodiments, electronic device 10 may be a model of an electronic device from another manufacturer.

As shown in FIG. 1, the electronic device 10 may include various components. The functional blocks shown in FIG. 1 may represent hardware elements (including circuitry), software elements (including code stored on a computer-readable medium) or a combination of both hardware and software elements. In the example of FIG. 1, the electronic device 10 includes input/output (I/O) ports 12, input structures 14, one or more processors 16, a memory 18, nonvolatile storage 20, network device 22, power source 24, display 26, and one or more imaging devices 28. It should be appreciated, however, that the components illustrated in FIG. 1 are provided only as an example. Other embodiments of the electronic device 10 may include more or fewer components. To provide one example, some embodiments of the electronic device 10 may not include the imaging device(s) 28.

Before continuing further, it should be noted that the system block diagram of the device 10 shown in FIG. 1 is intended to be a high-level control diagram depicting various components that may be included in such a device 10. That is, the connection lines between each individual component shown in FIG. 1 may not necessarily represent paths or directions through which data flows or is transmitted between various components of the device 10. Indeed, as discussed below, the depicted processor(s) 16 may, in some embodiments, include multiple processors, such as a main processor (e.g., CPU), and dedicated image and/or video processors. In such embodiments, the processing of image data may be primarily handled by these dedicated processors, thus effectively offloading such tasks from a main processor (CPU).

Considering each of the components of FIG. 1, the I/O ports 12 may represent ports to connect to a variety of devices, such as a power source, an audio output device, or other electronic devices. The input structures 14 may enable user input to the electronic device, and may include hardware keys, a touch-sensitive element of the display 26, and/or a microphone.

The processor(s) 16 may control the general operation of the device 10. For instance, the processor(s) 16 may execute an operating system, programs, user and application interfaces, and other functions of the electronic device 10. The processor(s) 16 may include one or more microprocessors and/or application-specific microprocessors (ASICs), or a combination of such processing components. For example, the processor(s) 16 may include one or more instruction set (e.g., RISC) processors, as well as graphics processors (GPU), video processors, audio processors and/or related chip sets. As may be appreciated, the processor(s) 16 may be coupled to one or more data buses for transferring data and instructions between various components of the device 10. In certain embodiments, the processor(s) 16 may provide the processing capability to execute an imaging applications on the electronic device 10, such as Photo Booth®, Aperture®, iPhoto®, Preview®, iMovie®, or Final Cut Pro® available from Apple Inc., or the "Camera" and/or "Photo" applications provided by Apple Inc. and available on some models of the iPhone®, iPod®, and iPad®.

A computer-readable medium, such as the memory 18 or the nonvolatile storage 20, may store the instructions or data to be processed by the processor(s) 16. The memory 18 may include any suitable memory device, such as random-access memory (RAM) or read only memory (ROM). The nonvolatile storage 20 may include flash memory, a hard drive, or any other optical, magnetic, and/or solid-state storage media. The memory 18 and/or the nonvolatile storage 20 may store firmware, data files, image data, software programs and applications, and so forth.

The network device 22 may be a network controller or a network interface card (NIC), and may enable network communication over a local area network (LAN) (e.g., Wi-Fi), a personal area network (e.g., Bluetooth), and/or a wide area network (WAN) (e.g., a 3G or 4G data network). The power source 24 of the device 10 may include a Li-ion battery and/or a power supply unit (PSU) to draw power from an electrical outlet or an alternating-current (AC) power supply.

The display 26 may display various images generated by device 10, such as a GUI for an operating system or image data (including still images and video data). The display 26 may be any suitable type of display, such as a liquid crystal display (LCD), plasma display, or an organic light emitting diode (OLED) display, for example. In one embodiment, the display 26 may include self-emissive pixels such as organic light emitting diodes (OLEDs) or micro-light-emitting-diodes (μ-LEDs).

Additionally, as mentioned above, the display 26 may include a touch-sensitive element that may represent an input structure 14 of the electronic device 10. The imaging device(s) 28 of the electronic device 10 may represent a digital camera that may acquire both still images and video. Each imaging device 28 may include a lens and an image sensor capture and convert light into electrical signals.

In certain embodiments, the electronic device 10 may include a compensation system 30, which may include a chip, such as processor or ASIC, that may control various aspects of the display 26. It should be noted that the compensation system 30 may be implemented in the CPU, the GPU, image signal processing pipeline, display pipeline, driving silicon, or any suitable processing device that is capable of processing image data in the digital domain before the image data is provided to the pixel circuitry.

In certain embodiments, the compensation system 30 may compensate for non-uniform gray levels and luminance properties for each pixel of the display 26. Generally, when the same electrical signal (e.g., voltage or current) is provided to each pixel of the display 26, each pixel should depict the same gray level. However, due to various sources of noise, frame mura effects, color mixing due to mask misalignment, and the like, the same voltage being applied to a number of pixels may result in a variety of different gray levels or luminance values depicted across the number of pixels. As such, the compensation system 30 may determine one or more compensation factors to adjust a digital value provided to each pixel to compensate for these differences. The compensation system 30 may then adjust the data signals provided to each pixel based on the compensation factors.

Figure 2:
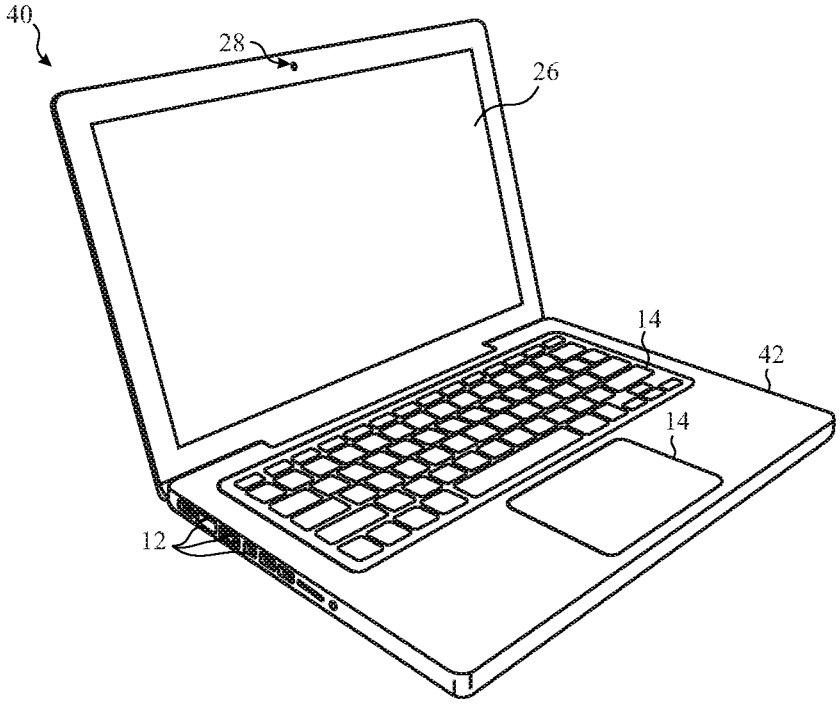
FIG. 2 is a perspective view of the electronic device of FIG. 1 in the form of a notebook computing device, in accordance with embodiments described herein.

As mentioned above, the electronic device 10 may take any number of suitable forms. Some examples of these possible forms appear in FIGS. 2-5. Turning to FIG. 2, a notebook computer 40 may include a housing 42, the display 26, the I/O ports 12, and the input structures 14. The input structures 14 may include a keyboard and a touchpad mouse that are integrated with the housing 42. Additionally, the input structure 14 may include various other buttons and/or switches which may be used to interact with the computer 40, such as to power on or start the computer, to operate a GUI or an application running on the computer 40, as well as adjust various other aspects relating to operation of the computer 40 (e.g., sound volume, display brightness, etc.). The computer 40 may also include various I/O ports 12 that provide for connectivity to additional devices, as discussed above, such as a FireWire® or USB port, a high definition multimedia interface (HDMI) port, or any other type of port that is suitable for connecting to an external device. Additionally, the computer 40 may include network connectivity (e.g., network device 22), memory (e.g., memory 18), and storage capabilities (e.g., storage device 20), as described above with respect to FIG. 1.

The notebook computer 40 may include an integrated imaging device 28 (e.g., a camera). In other embodiments, the notebook computer 40 may use an external camera (e.g., an external USB camera or a "webcam") connected to one or more of the I/O ports 12 instead of or in addition to the integrated imaging device 28. In certain embodiments, the depicted notebook computer 40 may be a model of a MacBook®, MacBook® Pro, MacBook Air®, or PowerBook® available from Apple Inc. In other embodiments, the computer 40 may be portable tablet computing device, such as a model of an iPad® from Apple Inc.

Figure 3:
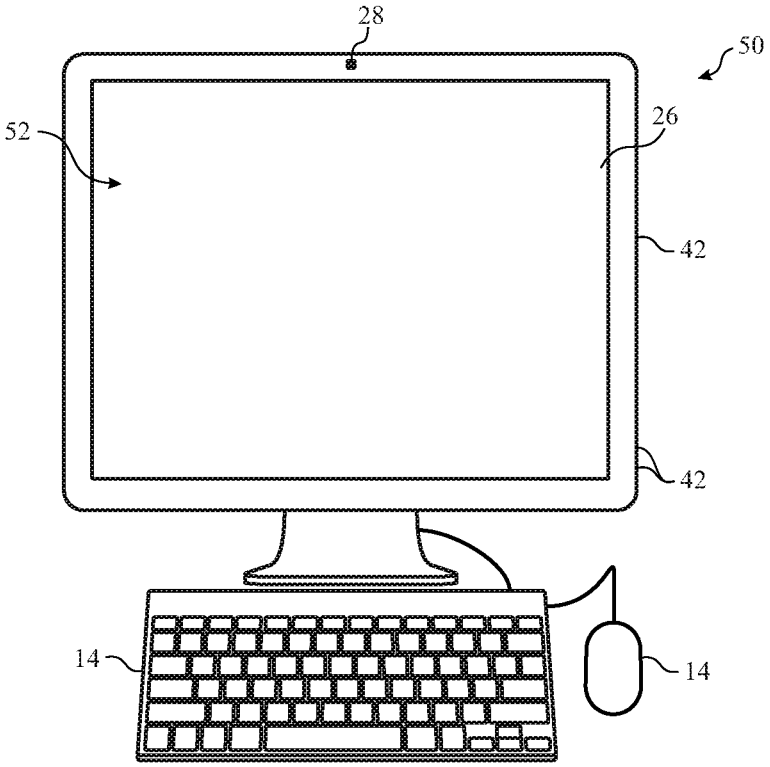
FIG. 3 is a front view of the electronic device of FIG. 1 in the form of a desktop computing device, in accordance with embodiments described herein.

FIG. 3 shows the electronic device 10 in the form of a desktop computer 50. The desktop computer 50 may include a number of features that may be generally similar to those provided by the notebook computer 40 shown in FIG. 4, but may have a generally larger overall form factor. As shown, the desktop computer 50 may be housed in an enclosure or housing 42 that includes the display 26, as well as various other components discussed above with regard to the block diagram shown in FIG. 1. Further, the desktop computer 50 may include an external keyboard and mouse (input structures 14) that may be coupled to the computer 50 via one or more I/O ports 12 (e.g., USB) or may communicate with the computer 50 wirelessly (e.g., RF, Bluetooth, etc.). The desktop computer 50 also includes an imaging device 28, which may be an integrated or external camera, as discussed above. In certain embodiments, the depicted desktop computer 50 may be a model of an iMac®, Mac® mini, or Mac Pro®, available from Apple Inc.

Figure 4:
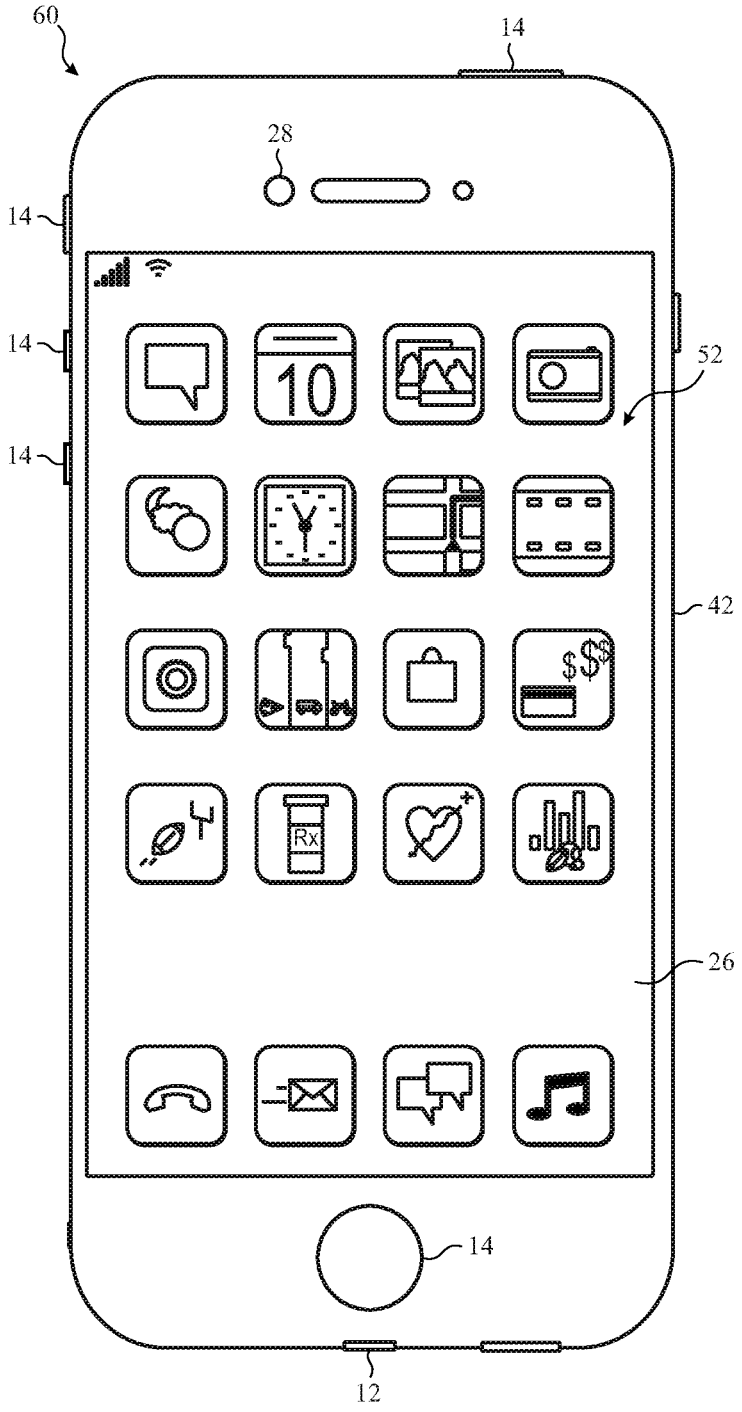
FIG. 4 is a front view of the electronic device of FIG. 1 in the form of a handheld portable electronic device, in accordance with embodiments described herein.
Figure 5:
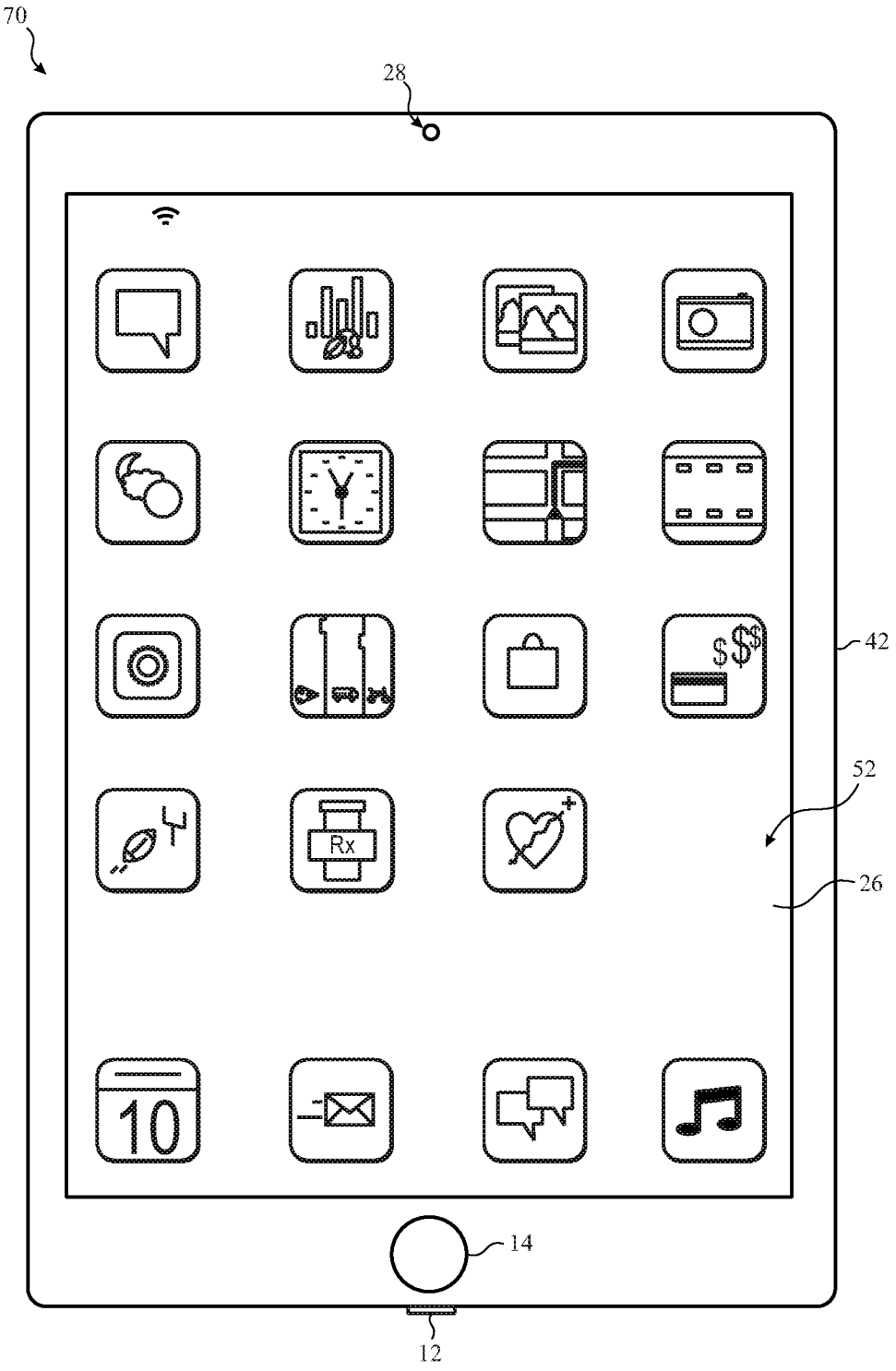
FIG. 5 is a front view of the electronic device of FIG. 1 in the form of a tablet computing device, in accordance with embodiments described herein.

The electronic device 10 may also take the form of portable handheld device 60 or 70, as shown in FIGS. 4 and 5. By way of example, the handheld device 60 or 70 may be a model of an iPod® or iPhone® available from Apple Inc. The handheld device 60 or 70 includes an enclosure or the housing 42, which may function to protect the interior components from physical damage and to shield them from electromagnetic interference. The housing 42 also includes various user input structures 14 through which a user may interface with the handheld device 60 or 70. Each input structure 14 may control various device functions when pressed or actuated. As shown in FIGS. 4 and 5, the handheld device 60 or 70 may also include various I/O ports 12. For instance, the depicted I/O ports 12 may include a proprietary connection port for transmitting and receiving data files or for charging a power source 24. Further, the I/O ports 12 may also be used to output voltage, current, and power to other connected devices.

The display 26 may display images generated by the handheld device 60 or 70. For example, the display 26 may display system indicators that may indicate device power status, signal strength, external device connections, and so forth. The display 26 may also display a GUI 52 that allows a user to interact with the device 60 or 70, as discussed above with reference to FIG. 3. The GUI 52 may include graphical elements, such as the icons, which may correspond to various applications that may be opened or executed upon detecting a user selection of a respective icon.

Figure 6:
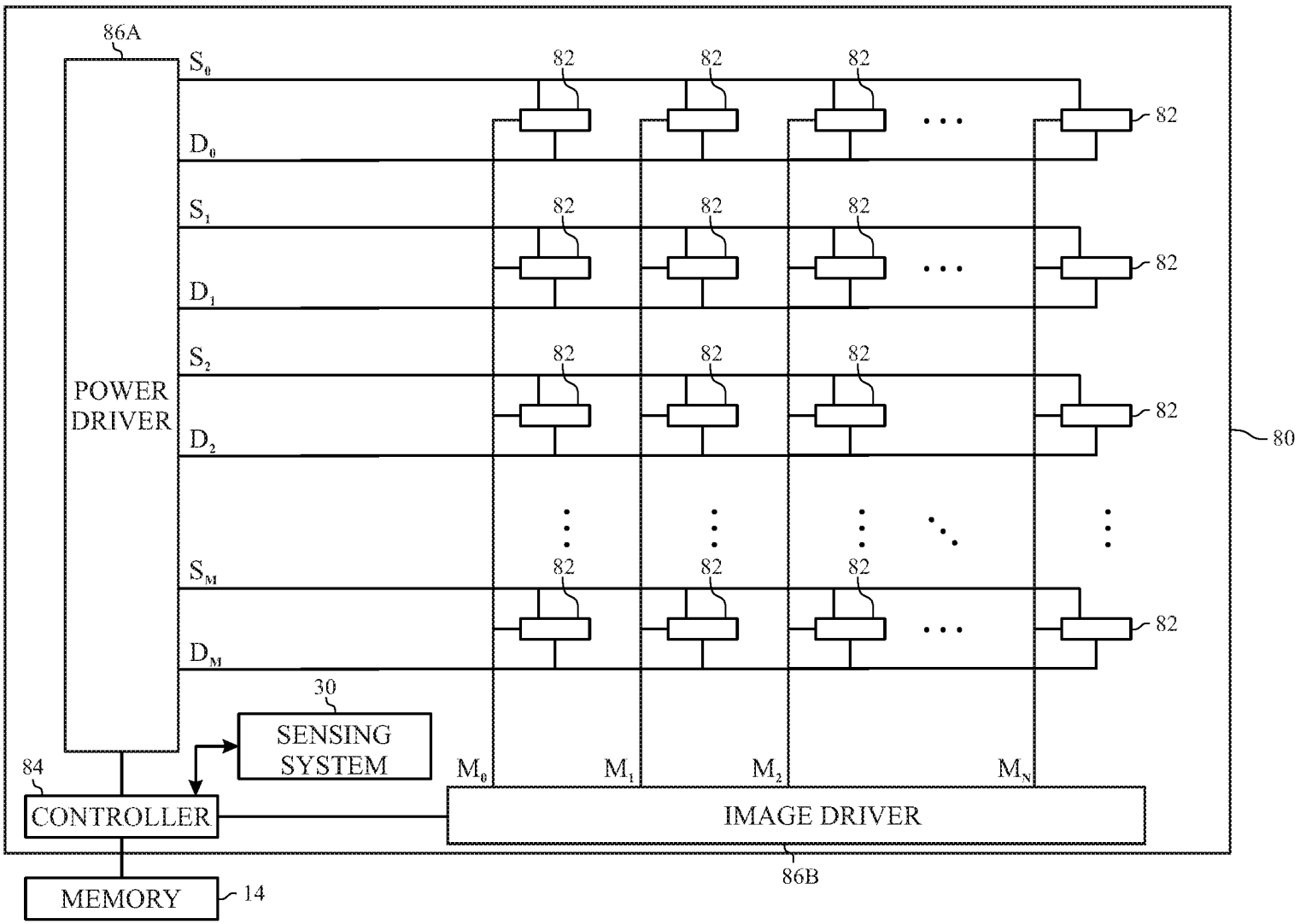
FIG. 6 is a circuit diagram of an array of self-emissive pixels of the electronic display of the electronic device of FIG. 1, in accordance with aspects of the present disclosure.

Having provided some context with regard to possible forms that the electronic device 10 may take, the present discussion will now focus on the compensation system 30 of FIG. 1. Generally, the brightness depicted by each respective pixel in the display 26 is controlled by varying an electric field associated with each respective pixel in the display 26. Keeping this in mind, FIG. 6 illustrates one embodiment of a circuit diagram of display 26 that may generate the electrical field that energizes each respective pixel and causes each respective pixel to emit light at an intensity corresponding to an applied voltage. As shown, display 26 may include a self-emissive pixel array 80 having an array of self-emissive pixels 82.

The self-emissive pixel array 80 is shown having a controller 84, a power driver 86A, an image driver 86B, and the array of self-emissive pixels 82. The self-emissive pixels 82 are driven by the power driver 86A and image driver 86B. Each power driver 86A and image driver 86B may drive one or more self-emissive pixels 82. In some embodiments, the power driver 86A and the image driver 86B may include multiple channels for independently driving multiple self-emissive pixels 82. The self-emissive pixels may include any suitable light-emitting elements, such as organic light emitting diodes (OLEDs), micro-light-emitting-diodes (μ-LEDs), and the like.

The power driver 86A may be connected to the self-emissive pixels 82 by way of scan lines $S_0$, $S_1$, . . . $S_{m-1}$, and $S_m$ and driving lines $D_0$, $D_1$, . . . $D_{m-1}$, and $D_m$. The self-emissive pixels 82 receive on/off instructions through the scan lines $S_0$, $S_1$, $S_{m-1}$, and $S_m$ and generate driving currents corresponding to data voltages transmitted from the driving lines $D_0$, $D_1$, . . . $D_{m-1}$, and $D_m$. The driving currents are applied to each self-emissive pixel 82 to emit light according to instructions from the image driver 86B through driving lines $M_0$, $M_1$, . . . $M_{n-1}$, and $M_n$. Both the power driver 86A and the image driver 86B transmit voltage signals through respective driving lines to operate each self-emissive pixel 82 at a state determined by the controller 84 to emit light. Each driver may supply voltage signals at a duty cycle and/or amplitude sufficient to operate each self-emissive pixel 82.

The controller 84 may control the color of the self-emissive pixels 82 using image data generated by the processor(s) 16 and stored into the memory 18 or provided directly from the processor(s) 16 to the controller 84. The compensation system 30 may receive the image data generated by the processor and adjust the image data to generate compensated image data that improves the uniformity in color and brightness properties of the pixels 82. The compensation system 30 may provide the compensated image data to the controller 84, which may then transmit corresponding data signals to the self-emissive pixels 82, such that the self-emissive pixels 82 may depict substantially uniform color and luminance provided the same current input in accordance with the techniques that will be described in detail below.

Figure 7:
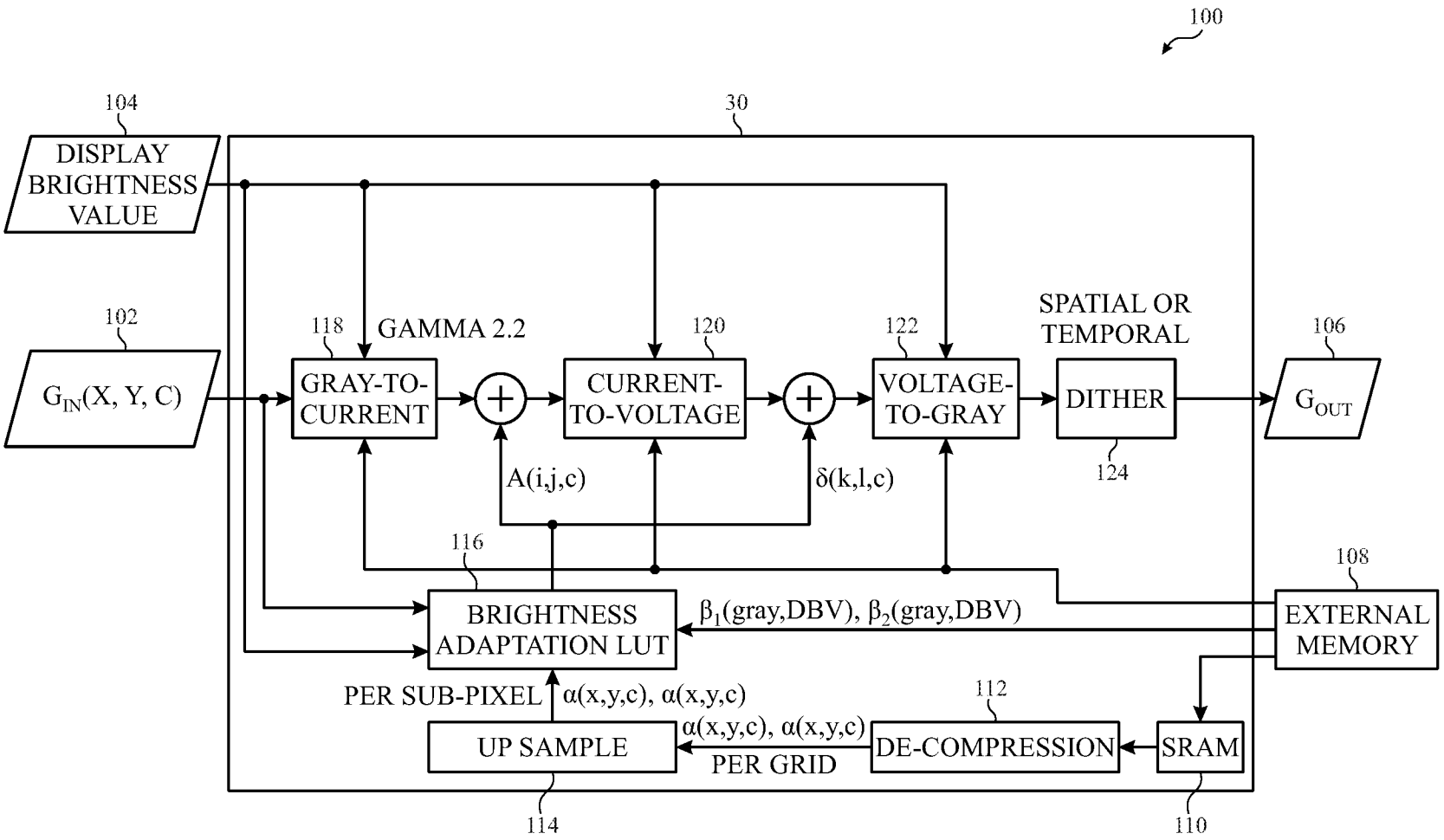
FIG. 7 is block diagram illustrating a process for compensating the pixel data of input image data to provide more uniform pixel characteristics across the display of the electronic device of FIG. 1, in accordance with embodiments described herein.

With the foregoing in mind, FIG. 7 illustrates a block diagram 100 of operations performed by the compensation system 30 indicating one embodiment in which the compensation system 30 may provide compensated image data to the pixels 82. It should be noted that the compensation system 30 may be implemented using software logic or hardware components. In any case, the compensation system 30 may receive input image data for each pixel 82 of the display 26, generate a compensated gray level value for each pixel 82, and provide the compensated gray level value to the respective pixel driving circuitry to cause the respective pixel 82 to illuminate according to the compensated gray level value.

Referring now to FIG. 7, the compensation system 30 may receive input image data that may include gray level data 102 that corresponds to a desire gray level for a respective pixel 82 of the display 26. The gray level data 102 may include a digital pixel value (e.g., gray level) for a respective pixel 82 of the display 26, as specified in image data provided to the controller 84 or the like. In addition, the gray level data 102 may specify a location of the pixel 82 (e.g., x-coordinate, y-coordinate) with respect to the display 26 and a color component (e.g., red, green, blue) associated with the pixel 82 of a sub-pixel of the pixel 82.

In addition to the gray level data 102, the compensation system 30 may receive a display brightness value (DBV) 104 that indicates a brightness value for the display 26. The DBV value 104 may correspond to a brightness setting or parameter applied to each of the pixels 82 of the display 26. In some cases, the DBV 104 of the display 26 may cause different pixels 82 that depict different gray level data and/or are located at different positions along the display 26 may illuminate differently based on the DBV 104. To ensure that each pixel 82 depicts a uniform color and luminance across the display 26 provided the same gray level data 102 and the DBV 104, the compensation system 30 may determine a gain compensation factor (e.g., A(i, j, c)) and an offset compensation factor (e.g., δ(k, l, c)) for different regions (e.g., grid of pixels) of the display 26 based on the gray level data 102 and the DBV 104. Using the gain compensation factor (e.g., A(i, j, c)) and the offset compensation factor (e.g., δ(k, l, c)), the compensation system 30 may determine compensated gray level data 106, which may be provided to the respective pixel 82 via respective pixel driving circuitry.

Generally, the compensation system 30 may determine a gain compensation factor (e.g., A(i, j, c)) and an offset compensation factor (e.g., δ(k, l, c)) for different regions of the display 26 based on the following relationship:

$$I_{TFT}=(1+A)*f(V_{data}-\delta) \quad (1)$$

where $I_{TFT}$ corresponds to a current provided to a respective pixel 82, A corresponds to the gain compensation factor applied to a current value to corresponds to a gray level of the respective pixel 82, $V_{data}$ corresponds to a gray level of the respective pixel 82, and δ corresponds to the offset compensation factor applied to a voltage associated with the current value. The gain compensation factor (A) and an offset compensation factor (δ) may be determined according to the following equations:

$$A=\alpha(x,y,c)*\beta_1(G_{IN},\text{DBV}) \quad (2)$$

$$\delta=\sigma(x,y,c)*\beta_2(G_{IN},\text{DBV}) \quad (3)$$

where α(x, y, c) corresponds to a gain value determined according to a correction spatial map based on a pixel's x- and y-coordinates and a color component (c) (e.g., red, green, blue sub-pixel), σ(x, y, c) corresponds to an offset value determined according to a correction spatial map based on a pixel's x- and y-coordinates and a color component (c) (e.g., red, green, blue sub-pixel), $\beta_1$ is a scaling factor applied to the gain value α(x, y, c) determined according to a brightness lookup table (LUT), $\beta_2$ is a scaling factor applied to the offset value σ(x, y, c) determined according to a brightness lookup table (LUT). Additional details with regard to the correction spatial map and the brightness LUT will be discussed below with reference to FIG. 7.

As shown in Equation (1) above, the current $I_{TFT}$ provided to the respective pixel 82 may be adjusted using the gain compensation factor (A) and the offset compensation factor (δ). As such, the compensation system 30 may determine the gain compensation factor (A) and the offset compensation factor (δ) based on the performance of the pixels 82 throughout the display 26 with respect to the location (x, y) of each pixel 82, the gray level value 102 to be depicted by each pixel 82, the DBV 104, and the like. Keeping the foregoing in mind and referring to FIG. 7, in certain embodiments, the compensation system 30 may be communicatively coupled to external memory 108, which may store information related to the performance of the pixels 82 of the display with respect to the gray level data 102 and the DBV 104.

By way of example, the external memory 108 may include a correction spatial map that provides gain (α(i, j, c)) and offset (σ(k, l, c)) compensation values for each pixel 82 of the display 26. The correction spatial map may be a lookup table (LUT) that provides the gain (α(i, j, c)) and offset (σ(k, l, c)) compensation values to adjust the input gray level data 102 for a respective pixel 82, such that each pixel 82 of the display 26 performs uniformly. In certain embodiments, the correction spatial map may be determined during manufacturing of the display 26 via optical testing used to determine the color differences across the pixels 82 of the panel for the display 26. In addition, the correction spatial map may be determined based on real-time sensing via a sensor that measure the illumination features of the pixel 82, the electrical properties (e.g., voltage/current) within the pixel 82, and the like. In yet another embodiment, the correction spatial map may be determined based on predictive models that use sensor data (e.g., thermal data, ambient light) acquired via sensors disposed on the display 26. In any case, the correction spatial map may specify the gain (α(i, j, c)) and offset (σ(k, l, c)) compensation values for a respective pixel 82 based on the location (e.g., x, y) of the pixel 82 and the color component (e.g., c) of the pixel 82.

In addition, it should be noted that in some embodiments, the correction spatial map may be stored in the external memory 108 as a collection of compressed and uncompressed data. Additional details with regard to the storage of the correction spatial map will be discussed below with reference to FIG. 11.

The correction spatial map may be organized according to different portions or grids (e.g., 3×3 pixels, 4×4 pixels) of the display 26 and a color component (c) of the pixel 82. As such, based on the location and color component of the pixel 82 associated with the gray level data 102, the correction spatial map may provide gain ($\alpha(i, j, c)$) and offset ($\sigma(k, l, c)$) compensation values that may be applied to a region or grid of pixels 82 in the display 26. With this in mind, it should be noted that the (i, j) coordinates of the gain ($\alpha(i, j, c)$) and offset ($\sigma(k, l, c)$) compensation values correspond a region or grid of pixels 82 in the display 26.

In some embodiments, the correction spatial map may be pre-loaded into a static random-access memory (SRAM) 110 of the compensation system 30, such that the compensation system 30 may perform its respective operations more quickly. The pre-loaded correction spatial map may be compressed to preserve memory in the SRAM 110. As such, when the compensation system 30 retrieves the pre-loaded correction spatial map from the SRAM 110, the compensation system 30 may decompress the pre-loaded correction spatial map using a de-compression component 112. After decompressing the pre-loaded correction spatial map, the compensation system 30 may receive gain ($\alpha(i, j, c)$) and offset ($\sigma(k, l, c)$) compensation values for different regions or grids of the display 26. The compression of the correction spatial map is described in greater detail below with reference to FIG. 11.

The gain ($\alpha(i, j, c)$) and offset ($\sigma(k, l, c)$) compensation values for different regions or grids of the display 26 may then be up-sampled by up sample component 114 to provide gain ($\alpha(x, y, c)$) and offset ($\sigma(x, y, c)$) compensation values for each sub-pixel of each pixel 82 of the display 26. The gain ($\alpha(x, y, c)$) and offset ($\sigma(x, y, c)$) compensation values may then be provided to a brightness adaptation lookup table (LUT) 116. In certain embodiments, the brightness adaptation LUT 116 may include a respective scaling factor (e.g., $\beta_1$, $\beta_2$) for the gain ($\alpha(x, y, c)$) and offset ($\sigma(x, y, c)$) compensation values. The brightness adaptation LUT 116 may be retrieved by the compensation system 30 from the external memory 108 and may be organized with respect to a gray level value provided via the gray level data 102 and a brightness value provided via the DBV 104 for each pixel 82. As such, the compensation system 30 may use the gray level data 102 and the DBV 104 to determine scaling factors ($\beta_1$ and $\beta_2$) to apply to the gain ($\alpha(x, y, c)$) and offset ($\sigma(x, y, c)$) compensation values provided by the up sample component 114. Like the correction spatial map described above, the brightness adaptation LUT 116 may be generated based on optical testing during manufacturing of the display 26, real-time sensing data regarding various features of the pixel 82, predictive models, and the like.

After applying the respective scaling factor (e.g., $\beta_1$, $\beta_2$) to the gain ($\alpha(x, y, c)$) and offset ($\sigma(x, y, c)$) compensation values, the compensation system 30 may obtain the gain compensation factor ($A(i, j, c)$) and the offset compensation factor ($\delta(k, l, c)$) to apply to the gray level data 102. To apply the gain compensation factor ($A(i, j, c)$) and the offset compensation factor ($\delta(k, l, c)$) to the gray level data 102, the compensation system 30 may perform a number of transformations to the gray level data 102. That is, the gain compensation factor ($A(i, j, c)$) may be applied in a current domain, while the offset compensation factor ($\delta(k, l, c)$) may be applied in a voltage domain. As such, the compensation system 30 may include a gray-to-current (G2I) transformation component 118, a current-to-voltage (I2V) transformation component, and a voltage-to-gray (V2G) transformation component 122.

As shown in FIG. 7, the compensation system 30 may send the gray level data 102 and the DBV 104 to the G2I transformation component 118. The G2I transformation component 118 may apply a gamma correction factor to the gray level data 102 based on the DBV 104. In addition, the G2I transformation component 118 may receive a gray conversion LUT from the external memory 108. As discussed above, the gray conversion LUT may provide replacement voltage and/or current values based on the gray level data 102 and the DBV 104. The gray conversion LUT may include data that is globally applied for each pixel 82 of the display 26. The gray conversion LUT is generated for each display panel manufacturer and compensates for gray level distortion due to manufacturing techniques and/or processes that affect each pixel 82. By way of operation, the G2I transformation component 118 may obtain a replacement gray value based on the gray level data 102 and the DBV 104 and then convert the replacement gray value to a current value.

The compensation system 30 may then apply the gain compensation factor ($A(i, j, c)$) to the current value. The resulting scaled current value may be provided to the I2V transformation component 120, which may convert the scaled current value to a voltage value. Like the G2I transformation component 118, the I2V transformation component 120 may receive gray conversion LUT from the external memory 108 and convert the scaled current or resulting voltage value to a corresponding replacement current or voltage value based on the DBV 104.

After the I2V transformation component 120 generates the voltage value, the compensation system 30 may add the offset compensation factor ($\delta(k, l, c)$) to the generated voltage value. The resulting compensated voltage value may be provided to the V2G transformation component 122 to convert the offset-compensated voltage value to a compensated gray value. Like the G2I transformation component 118 and the I2V transformation component 120 described above, the V2G transformation component 122 may also receive the gray conversion LUT from the external memory 108 and convert the compensated voltage value to a corresponding compensated replacement voltage value based on the DBV 104.

In any case, after the V2G transformation component 122 outputs the compensated gray value, a dithering component 124 receives the compensated gray value and may apply dithering effects to the compensated gray value to improve the quality of the resulting image displayed via the display 26. The dithering component 124 may apply a spatial or temporal dithering effect to the compensated gray value. The resulting gray value output by the dithering component 124 may include the compensated gray level data 106, which may be provided to a pixel driving circuit (e.g., controller 84, image driver 86B, power driver 86S), for display.

Although the G2I transformation component 118, the I2V transformation component 120, and the V2G transformation component 122 is described above as receiving and employing the gray conversion LUT, which may be the external memory 108, it should be noted that, in some embodiments, the gray conversion LUT may not be used by the compensation system 30. In this case, the compensation system 30 may perform each of the respective actions described above without determining a respective replacement value.

Figure 8:
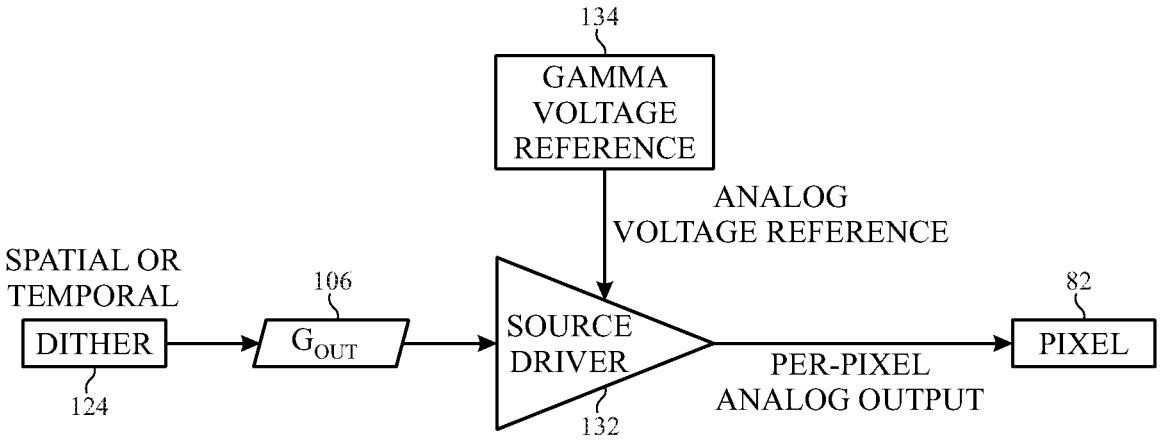
FIG. 8 is a block diagram of a post processing block for generating compensated image data for display by the electronic device of FIG. 1, in accordance with embodiments described herein.

To display the compensated gray level data 106, the compensation system 30 may send the compensated gray level data 106 to a source driver 132 as illustrated in FIG. 8. The compensated gray level data 106 may correspond to a digital code that indicates a gray level that the respective pixel 82 should depict. In some embodiments, the source driver 132 may correspond to the power driver 86A, the image driver 86B, or any suitable integrated circuit that may provide an analog voltage or current output to the respective pixel 82. In certain embodiments, the source driver 132 may determine the analog voltage or current output based on the compensated gray level data 106 and a gamma voltage reference 134. After receiving the analog voltage or current output from the source driver 132, the respective pixel 82 may illuminate to a corresponding gray level to depict image data via the display 26.

Provided the compensation techniques described above, it becomes apparent that the compensated gray level data 106 includes a gray level adjustment (±ΔG), as compared to the original input gray level data 102. That is, the compensated gray level data 106 may be higher or lower than the gray level data 102. As such, the compensated gray level data 106 may be outside a range of values (e.g., 0-255) that correspond to valid gray level data that can be depicted by a respective pixel 82 and may result in saturated pixel data being depicted by the display 26.

Figure 9:
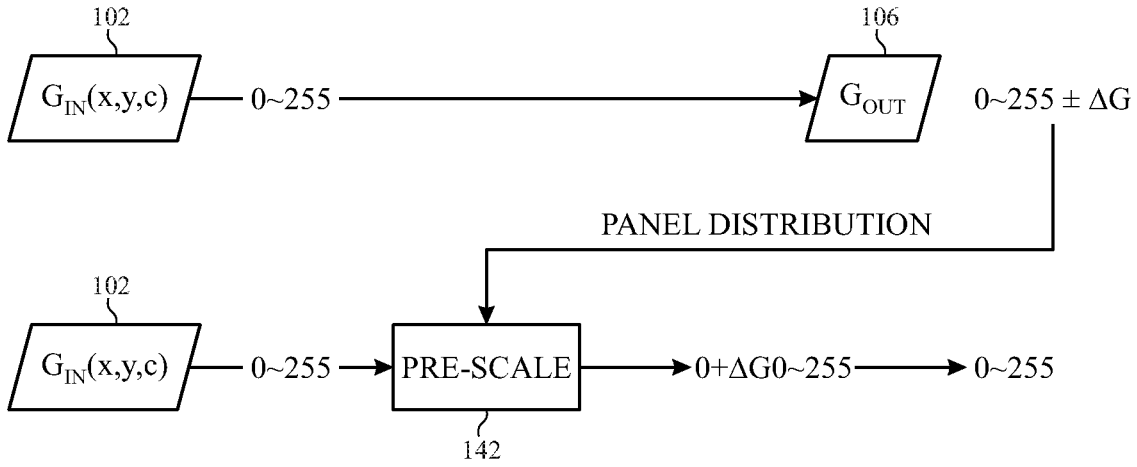
FIG. 9 is a block diagram of a pre-processing block for generating compensated image data for display by the electronic device of FIG. 1, in accordance with embodiments described herein.

With this in mind, in some embodiments, a total correction range may be calculated for each display 26 manufactured by the same entity. The total correction range may include a maximum gray level adjustment (±ΔG) that each pixel 82 may expect to be adjusted based on the techniques described above. In some embodiments, the maximum gray level adjustment (±ΔG) may be determined based on performing the compensation techniques described above for a collection of displays 26 provided by a particular manufacturer, as the distortion of the gray level may be consistent with each supplier. After determining the maximum gray level adjustment (±ΔG), a pre-scale component 142 may be employed to scale the gray level data 102 prior to performing the compensation techniques described above with respect to FIG. 7. That is, the gray level data 102 may add or subtract the maximum gray level adjustment (±ΔG) to keep the gray level data 102 within the range of available data that may be presented by the respective pixel 82, as shown in FIG. 9. As such, after the pre-scaled gray level data 102 is adjusted based on the techniques described above, the resulting gray level data 106 may not be outside the available data range of the respective pixel 82.

Figure 10:
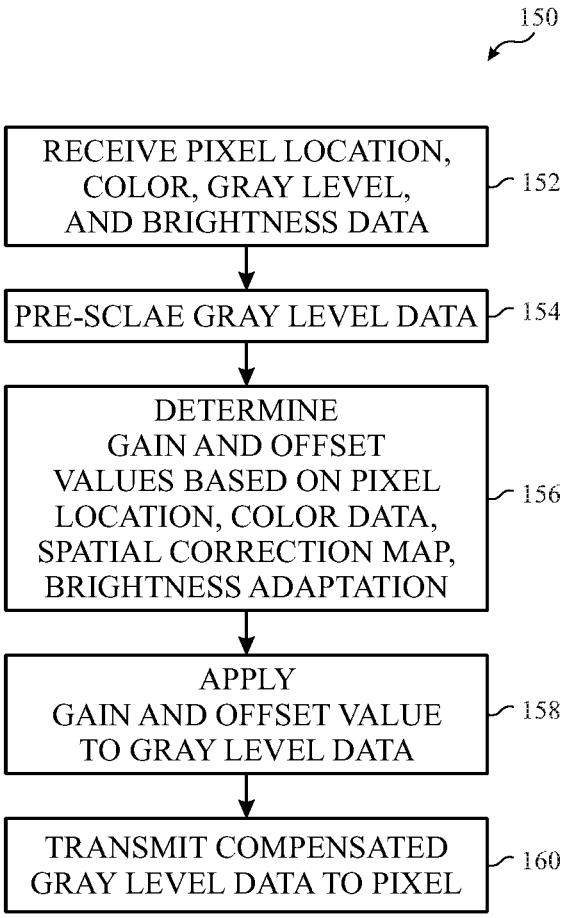
FIG. 10 is a flow chart of a method for compensating the pixel data of input image data to provide more uniform pixel characteristics across the display of the electronic device of FIG. 1, in accordance with embodiments described herein.

With the foregoing in mind, FIG. 10 illustrates a flow chart of a method 150 for compensating the gray level data 102 provided to each pixel 82 of the display 26 to improve non-uniform color and luminance properties of the pixels 82 of the display 26. The following description of the method 150 will be described as being performed by the compensation system 30, but it should be understood that the process described herein may be performed by any suitable processor(s) that processes image data for display via the pixels 82. In addition, although the method 150 is described in a particular order, is should be understood that the method 150 may be performed in any suitable order.

Referring now to FIG. 10, at block 152, the compensation system 30 may receive pixel location data (e.g., Cartesian coordinates), gray level digital value, sub-pixel color data (e.g., red, green, blue), and the DBV 104 for each pixel 82. In one embodiment, the gray level data 102 and the DBV 104 may be based on the input image data received by the controller 84 or the like. In one embodiment, the location of each pixel 82 may be used to identify a certain block of pixels 82 that corresponds to each respective pixel 82. The identified blocks may later be used to determine gain and offset values to adjust the gray level data 102 and improve the uniformity depiction of gray level data across the display 26.

At block 154, the compensation system 30 may pre-scale the gray level data 102 to add or subtract the maximum gray level adjustment (±ΔG), such that the compensated gray level data 106 may remain within the range of available gray level values that may be depicted by the respective pixel 82. At block 156, the compensation system 30 may determine a gain compensation factor (e.g., A(i, j, c)) and an offset compensation factor (e.g., δ(i, j, c)) for each gray level data 102 of each pixel 82 of the display 26. As discussed above, the gain compensation factor (e.g., A(i, j, c)) and the offset compensation factor (e.g., δ(k, l, c)) may be determined based on the location of the respective pixel 82 associated with the gray level data 102, the color data, the correction spatial map, the brightness adaptation LUT, and the gray conversion LUT, as described above.

At block 158, the compensation system 30 may apply the gain compensation factor (e.g., A(i, j, c)) and the offset compensation factor (e.g., δ(k, l, c)) to the gray level data 102 in accordance with the embodiments described herein. As discussed above, the gain compensation factor (e.g., A(i, j, c)) may be applied to a current value determined based on the G2I transformation component 118, the pre-scaled gray level data 102, and the DBV 104. The offset compensation factor (e.g., δ(k, l, c)) may be added to a voltage value output by the I2V transformation component 120.

After applying the gain compensation factor (e.g., A(i, j, c)) and the offset compensation factor (e.g., δ(k, l, c)) to the gray level data 102, at block 160, the compensation system 30 may transmit the compensated gray level data 106 to the respective pixel driving circuitry (e.g., source driver 132), which may provide a corresponding voltage or current signal to the respective pixel 82 and cause the respective pixel 82 to illuminate to a particular gray level based on the provided voltage or current signal. In certain embodiments, prior to transmitting the compensated gray level data 106, the compensation system may convert a voltage value output by the I2V transformation component 120 and adjusted by the offset compensation factor (e.g., δ(k, l, c)) to a gray level value, which may be dithered in order to generate the compensated gray level data 106.

Referring briefly back to FIG. 7, as discussed above, the external memory 108 may store a correction spatial map that provides gain (α(i, j, c)) and offset (σ(i, j, c)) compensation values for each pixel 82 of the display 26. To preserve the memory or storage available in the external memory 108, in some embodiments, the correction spatial map may be stored in such a manner that it includes compressed and uncompressed data. For example, a portion of the correction spatial map for one or more pixels 82, a row of pixels 82, a column of pixels 82, or the like may be stored in the external memory 108 as uncompressed data. The remaining portion of the correction spatial map may be stored in the external memory 108 as compressed data that characterizes the difference or delta between the gain (α(i, j, c)) and offset (σ(i, j, c)) compensation values for each pixel 82 of the uncompressed portion of the correction spatial map and the remaining pixels 82 of display 26. That is, a first set of data that characterizes the gain (α(i, j, c)) and offset (σ(i, j, c)) compensation values for a respective set of pixels 82 may be stored as uncompressed data. A second set of data, which may be compressed, may be uncompressed by the compensation system 30 to obtain a change, difference, or delta between the uncompressed gain ($\alpha(i, j, c)$) and offset ($\sigma(i, j, c)$) compensation values for the respective pixels 82 of the first set of data and the respective pixels 82 represented by the second set of data.

Figure 11:
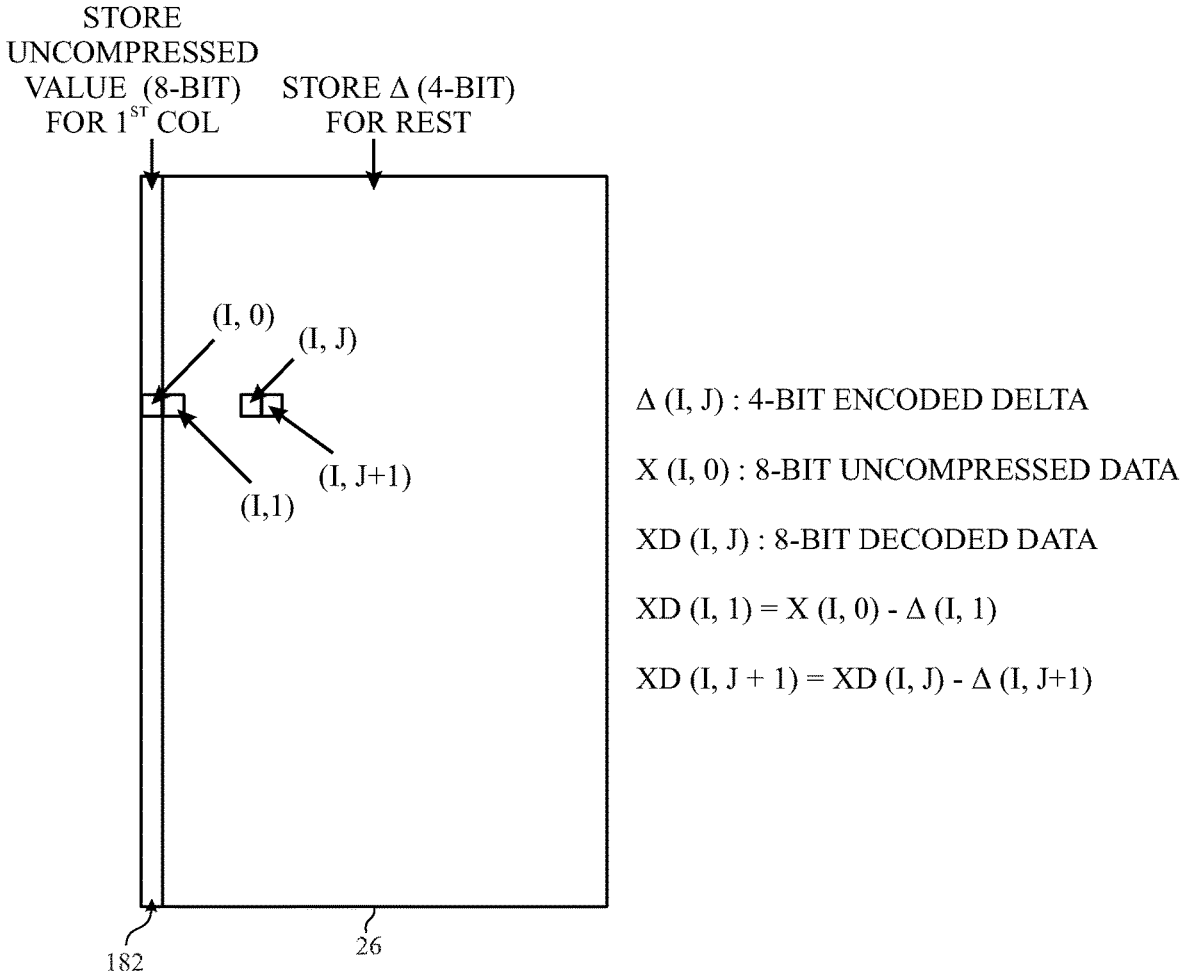
FIG. 11 is a diagram that illustrates how uncompressed and compressed data may be stored in external memory for compensating the pixel data of input image data to provide more uniform pixel characteristics across the display of the electronic device of FIG. 1, in accordance with embodiments described herein.

By way of example, FIG. 11 illustrates a diagram that depicts the relationship between uncompressed and compressed data that may be stored as the correction spatial map in the external memory 108. As shown in FIG. 11, the correction spatial map may include uncompressed gain ($\alpha(i, j, c)$) and offset ($\delta(i, j, c)$) compensation values a column 182 of pixels 82. The column 82, as depicted in FIG. 11, may be the first column of pixels 82 in the display 26. However, in other embodiments, the uncompressed column of gain ($\alpha(i, j, c)$) and offset ($\sigma(i, j, c)$) compensation values stored in the correction spatial map may correspond to any suitable column of pixels 82 in the display 26.

In addition to the uncompressed gain ($\alpha(i, j, c)$) and offset ($\sigma(i, j, c)$) compensation values for the column 182, the spatial correction map may include compressed difference or delta values that corresponds to gain ($\alpha(i, j, c)$) and offset ($\sigma(i, j, c)$) compensation values for the remaining columns of the display 26. For example, the spatial correction map may include 8-bit uncompressed data for each row of pixels 82 that are on the column 182. In addition, the spatial correction map may include a 4-bit encoded delta value that represents a difference between the uncompressed gain ($\alpha(i, j, c)$) and offset ($\sigma(i, j, c)$) compensation values for a respective pixel 82 in column 182 and another pixel 82 in a different column of the display 26.

By way of example, the 8-bit uncompressed data for a pixel 82 located at row i and column 0 (e.g., column 182) may be represented as: x(i, 0). The 4-bit compressed or encoded delta for the pixel 82 located at row i and column j may be represented as: $\Delta(i, j)$. With this in mind, when determining the gain ($\alpha(i, j, c)$) and offset ($\sigma(i, j, c)$) compensation values to provide to the up-sample component 114, the compensation system 30 may retrieve the spatial correction map via the external memory 108 and/or the SRAM 110, and the de-compression component 112 may decompress the 4-bit compressed or encoded delta for the pixel 82 located at row i and column j (e.g., $\Delta(i, j)$. The compensation system 30 may then determine the gain ($\alpha(i, j, c)$) and offset ($\sigma(i, j, c)$) compensation values for the pixel located at (i, j) as provided below:

$$x_d(i,1)=x(i,0)-\Delta(i,1)$$

$$x_d(i,j+1)=x_d(i,j)-\Delta(i,j+1)$$

By storing a portion of the spatial correction map as uncompressed data and the remaining portion of the spatial correction map as compressed data, the compensation system 30 may preserve more memory in the external memory 108 or the SRAM 110 for other data. That is, the encoded delta values that are stored as part of the spatial correction map includes fewer bits than the corresponding uncompressed values.

In addition to the example provided above, subpixel (e.g., R/G/B) offset/gain data uncompressed (8-bit) for a 1st column of the display 26 may be stored in the spatial correction map and subpixel (e.g., R/G/B) delta offset/gain (4-bit) data between horizontally adjacent pixels for the remaining columns. In another embodiment, subpixel (e.g., R/G/B) offset/gain data uncompressed (8-bit) for the 1st row or the display 26 may be stored in the spatial correction map and the subpixel (e.g., R/G/B) delta offset/gain (4-bit) between horizontally adjacent pixels for the remaining columns may be stored. In yet another embodiment, subpixel (e.g., R/G/B) offset/gain data uncompressed (8-bit) for a 1st pixel in the display 26 may be stored in the spatial compression map, along with subpixel (e.g., R/G/B) delta offset/gain (4-bit) between adjacent pixels scanning the display 26 on a serpentine or other suitable path.

It should be noted that in some embodiments, the encoded or compressed data of the spatial correction map may be encoded using an iterative encoding scheme. The iterative encoding scheme may account for a maximum compression quantization error to prevent error propagation and limit the maximum compression quantization error of [−Min_precision/2+Min_precision/2].

In addition, the encoding scheme may be combined with variable length coding schemes (e.g., Huffman coding) to achieve an improved compression ratio. This scheme could also be extended to take advantage of potential color redundancy between R/G/B sub-pixels. For example, 4 bits may be used to store the red value of a given pixel, and 3 bits may be used to store the values for the green and blue components.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A display device, comprising:

a display comprising a plurality of pixels; and a processor configured to:

receive image data configured to be displayed via the plurality of pixels, wherein the image data comprises gray level data and display brightness value (DBV) data for a first pixel of the plurality of pixels;

determine a gain compensation factor associated with the first pixel based on a correction spatial map comprising a plurality of gain compensation values organized with respect to a location of a pixel and a color component of the pixel, a brightness adaptation lookup table (LUT) organized with respect to a gray level value and a display brightness value (DBV) associated with the pixel, the gray level data, and the DBV data;

determine an offset compensation factor associated with the first pixel based on the correction spatial map comprising a plurality of offset compensation values organized with respect to the location of the pixel and the color component of the pixel, the brightness adaptation lookup table (LUT), the gray level data, and the DBV data, wherein the gain compensation factor and the offset compensation factor are configured to compensate for one or more non-uniformity properties of the first pixel with respect to the plurality of pixels, and wherein the plurality of gain compensation values and the plurality of offset compensation values are organized with respect to a grid of pixels of the plurality of pixels;

generate compensated gray level data by applying the gain compensation factor and the offset compensation factor to the gray level data; and transmit the compensated gray level data to pixel driving circuitry associated with the first pixel.

2. The display device of claim 1, wherein the correction spatial map comprises:

a first portion of the plurality of gain compensation values that is uncompressed; and a second portion of the plurality of gain compensation values that is compressed.

3. The display device of claim 1 wherein the processor is configured to up sample a first gain compensation value of the plurality of gain compensation values and a first offset compensation value of the plurality of offset compensation values based on the location of the pixel and the grid of pixels.

4. The display device of claim 1, wherein the brightness adaptation LUT comprises a plurality of first scaling factors configured to be applied to a first gain compensation value of the plurality of gain compensation values and a plurality of second scaling factors configured to be applied to a second gain compensation value of the plurality of gain compensation values.

5. The display device of claim 1, wherein the processor is configured to:

convert the gray level value of the gray level data to a current value; and generate a gain-compensated current value by applying the gain compensation factor to the current value.

6. The display device of claim 5, wherein the processor is configured to: convert the gain-compensated current value to a voltage value; and generate an offset-compensated voltage value by applying the offset compensation factor to the voltage value.

7. The display device of claim 6, wherein the processor is configured to: convert the offset-compensated voltage value into a compensated gray level value; dither the compensated gray level value; and transmit the gray level value to the pixel driving circuitry.

8. A method for compensating one or more pixels of a plurality of pixels in a display, comprising:

receiving, via a processor, image data configured to be displayed via the plurality of pixels, wherein the image data comprises gray level data and display brightness value (DBV) data for a first pixel of the plurality of pixels;

pre-scaling, via the processor, a gray level value of the gray level data based on an expected gray level adjustment associated with the display;

determining, via the processor, a gain compensation factor associated with the first pixel based on a correction spatial map comprising a plurality of gain compensation values organized with respect to a location of a pixel and a color component of the pixel, a brightness adaptation lookup table (LUT) organized with respect to a replacement gray level value and a display brightness value (DBV) associated with the pixel, the gray level data, and the DBV data;

determining, via the processor, an offset compensation factor associated with the first pixel based on the correction spatial map comprising a plurality of offset compensation values organized with respect to the location of the pixel and the color component of the pixel, the brightness adaptation lookup table (LUT), the gray level data, and the DBV data, wherein the gain compensation factor and the offset compensation factor are configured to compensate for one or more non-uniformity properties of the first pixel with respect to the plurality of pixels, and wherein the plurality of gain compensation values and the plurality of offset compensation values are organized with respect to a grid of pixels of the plurality of pixels;

generating, via the processor, compensated gray level data by applying the gain compensation factor and the offset compensation factor to the gray level data; and transmitting, via the processor, the compensated gray level data to pixel driving circuitry associated with the first pixel.

9. The method of claim 8, comprising replacing, via the processor, the gray level value based on a gray conversion lookup table (LUT) associated with the display.

10. The method of claim 8, wherein the correction spatial map comprises:

a first portion of the plurality of offset compensation values that is uncompressed; and a second portion of the plurality of offset compensation values that is compressed.

11. The method of claim 10, wherein the brightness adaptation LUT is generated based on one or more optical tests performed during a manufacturing phase of the display.

12. The method of claim 8, comprising:

retrieving, via the processor, a compressed version of the correction spatial map stored in a static random-access memory (SRAM);

de-compressing, via the processor, the compressed version of the correction spatial map to generate the correction spatial map; and up-sampling, via the processor, a first gain compensation value of the plurality of gain compensation values and a first offset compensation value of the plurality of offset compensation values based on a first location of the first pixel.

13. The method of claim 8, wherein the compensated gray level data comprises a digital value.

14. A non-transitory computer-readable medium comprising computer-executable instructions configured to cause a processor to:

receive image data configured to be displayed via a plurality of pixels of a display, wherein the image data comprises gray level data and display brightness value (DBV) data for a first pixel of the plurality of pixels;

determine a gain compensation factor associated with the first pixel based on a correction spatial map comprising a plurality of gain compensation values organized with respect to a location of a pixel and a color component of the pixel, a brightness adaptation lookup table (LUT) organized with respect to a gray level value and a display brightness value (DBV) associated with the pixel, the gray level data, and the DBV data;

determine an offset compensation factor associated with the first pixel based on the correction spatial map comprising a plurality of offset compensation values organized with respect to the location of the pixel and the color component of the pixel, the brightness adaptation lookup table (LUT), the gray level data, and the DBV data, wherein the gain compensation factor and the offset compensation factor are configured to compensate for one or more non-uniformity properties of the first pixel with respect to the plurality of pixels;

generate compensated gray level data by applying the gain compensation factor and the offset compensation factor to the gray level data; and transmit the compensated gray level data to pixel driving circuitry associated with the first pixel, wherein the pixel driving circuitry comprises a source driver configured to adjust the compensated gray level data based on a gamma voltage reference.

15. The non-transitory computer-readable medium of claim 14, wherein the computer-executable instructions are configured to cause the processor to generate the compensated gray level data by:

converting the gray level value of the gray level data to a current value;

applying the gain compensation factor to the current value to generate a gain-compensated current value;

converting the gain-compensated current value to a voltage value;

applying the offset compensation factor to the voltage value to generate an offset-compensated voltage value; and converting the offset-compensated voltage value to a compensated gray level value.

16. The non-transitory computer-readable medium of claim 15, wherein the computer-executable instructions are configured to cause the processor to:

dither the compensated gray level value to generate a dithered gray level value; and transmit the dithered gray level value to the pixel driving circuitry.

17. The non-transitory computer-readable medium of claim 16, wherein the computer-executable instructions are configured to cause the processor to dither the compensated gray level value according to a spatial dither scheme or a temporal dither scheme.

18. The non-transitory computer-readable medium of claim 15, wherein the computer-executable instructions are configured to cause the processor to pre-scale the gray level value before converting the gray level value to the current value.

* * * * *